US011548125B2

(12) United States Patent
Ross

(10) Patent No.: US 11,548,125 B2
(45) Date of Patent: Jan. 10, 2023

(54) GROOVED DRIVE FOR RATCHET TOOLS

(71) Applicant: Snap-on Incorporated, Kenosha, WI (US)

(72) Inventor: David T. Ross, Antioch, IL (US)

(73) Assignee: Snap-on Incorporated, Kenosha, WI (US)

( * ) Notice: Subject to any disclaimer, the term of this patent is extended or adjusted under 35 U.S.C. 154(b) by 237 days.

(21) Appl. No.: 16/432,627

(22) Filed: Jun. 5, 2019

(65) Prior Publication Data

US 2020/0384619 A1 Dec. 10, 2020

(51) Int. Cl.
*B25B 23/142* (2006.01)
*B25B 23/00* (2006.01)
*B25B 13/46* (2006.01)

(52) U.S. Cl.
CPC ..... *B25B 23/1427* (2013.01); *B25B 13/463* (2013.01); *B25B 23/0035* (2013.01)

(58) Field of Classification Search
CPC ..... B25B 23/1427
USPC ..... 81/52
See application file for complete search history.

(56) References Cited

U.S. PATENT DOCUMENTS 1,428,840 A 9/1922 Gates
2,709,386 A 5/1955 Hopgood
2,800,821 A 7/1957 Fruscella
3,331,267 A 7/1967 Tietge
3,830,119 A * 8/1974 Travis ..... B25B 23/1415 81/477
4,108,027 A 8/1978 Lenker
4,602,534 A * 7/1986 Moetteli ..... B25G 3/18 81/177.85
5,007,311 A 4/1991 Lee
5,086,673 A 2/1992 Korty
5,507,208 A 4/1996 Pratt
5,662,174 A 9/1997 Vermilyer
6,067,881 A 5/2000 Albertson
6,276,239 B1 8/2001 Albertson
6,516,688 B2 2/2003 Albertson
6,712,484 B2 3/2004 Hsien
7,107,876 B1 9/2006 Chen
7,398,710 B1 7/2008 Ho
8,342,061 B2 1/2013 Super
(Continued)

FOREIGN PATENT DOCUMENTS

CN 201371438 Y 12/2009
CN 201669645 U 12/2010
(Continued)

OTHER PUBLICATIONS

Federal Specification, Socket, Wrench and Attachments GGG-W-660A (Year: 1954).*
(Continued)

*Primary Examiner* — David B. Thomas
*Assistant Examiner* — Jonathan G Santiago Martinez
(74) *Attorney, Agent, or Firm* — Seyfarth Shaw LLP

(57) ABSTRACT

A tool with a drive lug having groove formed on the drive lug to promote failure of the drive lug before internal component failure. The groove has a predetermined diameter and is formed on the drive lug or ratchet square to cause failure of the drive lug, due to a torsional ductile fracture, before any internal component failure of the tool, such as, for example, gear and/or pawl failure in a ratchet wrench.

18 Claims, 4 Drawing Sheets

(56) References Cited

U.S. PATENT DOCUMENTS

| | | | | |
|---|---|---|---|---|
| 8,516,927 | B1 * | 8/2013 | Wang | B25B 27/0035 81/62 |
| 9,757,847 | B2 | 9/2017 | Moreau et al. | |
| 2003/0154826 | A1 | 8/2003 | Lee | |
| 2004/0093991 | A1 | 5/2004 | Wojtynek | |
| 2005/0097995 | A1 * | 5/2005 | Hu | B25B 23/0035 81/177.85 |
| 2008/0047401 | A1 | 2/2008 | Lu | |
| 2009/0031867 | A1 | 2/2009 | Andronica et al. | |
| 2009/0145268 | A1 | 6/2009 | Laurie | |
| 2011/0283842 | A1 | 11/2011 | Lai | |
| 2012/0255403 | A1 | 10/2012 | Ehlers et al. | |
| 2019/0022834 | A1 | 1/2019 | Eggert et al. | |
| 2020/0070323 | A1 | 3/2020 | Thompson | |

FOREIGN PATENT DOCUMENTS

| | | | |
|---|---|---|---|
| EP | 3162506 | A1 | 5/2017 |
| TW | 200515977 | A | 5/2005 |
| TW | 200821096 | A | 5/2008 |
| TW | M550204 | U | 10/2017 |
| TW | M552411 | U | 12/2017 |
| WO | 2014014707 | | 1/2014 |

OTHER PUBLICATIONS

Federal Specification: Socket, Socket Wrench and Attachments GGG-W-660A (Year: 1973).*

Betancur Gómez, Juan Diego, Hoyos Gómez, Felipe, Osorio Patiño. (2017). Comparison of Stress Concentration Curves for Different Geometries of Machine Elements Obtained via Simulation and Experimentation. Tecciencia, 12(23), 93-101. https://doi.org/10.18180/tecciencia.2017.23.11 (Year: 2017).*

Taiwan Office Action for Application No. 11020025210 dated Jan. 12, 2021, 8 pages.

Examination Report for Application No. 2020201983 dated Feb. 16, 2021, 10 pages.

Combined Search and Examination Report for Application No. GB2004573.8 dated Sep. 16, 2020, 6 pages.

Taiwan Office Action for corresponding TW Application No. 109118721 dated May 3, 2021, 3 pages.

Chinese Office Action for corresponding CN Application No. 202010502167.3, dated Aug. 6, 2021, 8 pages.

Canadian Office Action for corresponding CA Application No. 3,081,868, dated Aug. 20, 2021, 4 pages.

United Kingdom Examination Report for corresponding UK Application No. GB2004573.8, dated Sep. 16, 2021, 3 pages.

Australian Examination Report No. 2 for corresponding AU Application No. 2020201983, dated Oct. 6, 2021, 5 pages.

United Kingdom Examination Report for corresponding UK Application No. GB2004573.8, dated Dec. 8, 2021, 3 pages.

Taiwan Office Action for corresponding TW Application No. 109118721, dated Dec. 27, 2021, 9 pages.

Chinese Office Action for corresponding Application No. 202010502167.3, dated May 30, 2022, 5 pages.

Taiwan Office Action for corresponding Application No. 109118721, dated Apr. 22, 2022, 10 pages.

Chinese Office Action for corresponding Application No. 202010502167.3 dated Feb. 11, 2022, 5 pages.

* cited by examiner

GROOVED DRIVE FOR RATCHET TOOLS

TECHNICAL FIELD OF THE INVENTION

The present invention relates generally to torque application tools. More particularly, the present invention relates to a drive head having a drive lug with a groove for a tool torque application tool.

BACKGROUND OF THE INVENTION

Torque application tools, such as ratchet tools, are common hand tool used to apply torque to work pieces. These tools can be in the form, for example, of a ratchet tool or breaker bar. Ratchet tools, for example, allow a user to rotate the tool in a first rotational direction to apply a first torqueing application, and to ratchet the tool in a second rotational direction, opposite the first rotational direction. The act of ratcheting the tool in the second rotational direction does not apply a reverse torque on the work piece because of a pawl mechanism that engages a gear when the tool is rotated in the first rotational direction, but that ratchets about the gear when the tool is rotated in the second rotational direction.

Compact head torque application tools use oversized lugs on small ratchet mechanisms (e.g., three eighths inch (⅜") square on a quarter inch (¼") ratchet to provide improved access to larger sockets/fastener sizes. Normally square fracture is the preferred failure mode for ratchets, but using larger lugs switches the failure mode to an internal mechanism of the ratchets. For example, compact head ratchets fail when the internal mechanism (such as the pawl or gear) inadvertently slips, which occurs suddenly with no feedback to the user before failure.

SUMMARY OF THE INVENTION

The present invention broadly relates to a tool with a drive lug having a groove formed on the drive lug to control failure of the drive lug before internal (gear or pawl) failure. The groove has a predetermined diameter and is formed on the drive lug or ratchet square to cause failure of the drive lug, due to a torsional ductile fracture, before any internal mechanism failure of the tool, such as gear failure and/or pawl failure.

In an embodiment, the present invention broadly relates to a tool including an internal component. The tool includes a drive lug and a groove formed in the drive lug that has a predetermined diameter adapted to promote failure of the drive lug prior to failure of the internal component.

In another embodiment, the present invention broadly relates to a tool with a handle, a ratchet head extending from the handle and including an internal component, and a drive lug extending from the ratchet head and adapted to engage a work piece. The drive lug includes a first end portion proximate to the ratchet head, a second end portion distal from the ratchet head, and a groove formed in the drive lug between the first and second end portions. The groove has a predetermined diameter adapted to promote failure of the drive lug prior to failure of the internal component.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
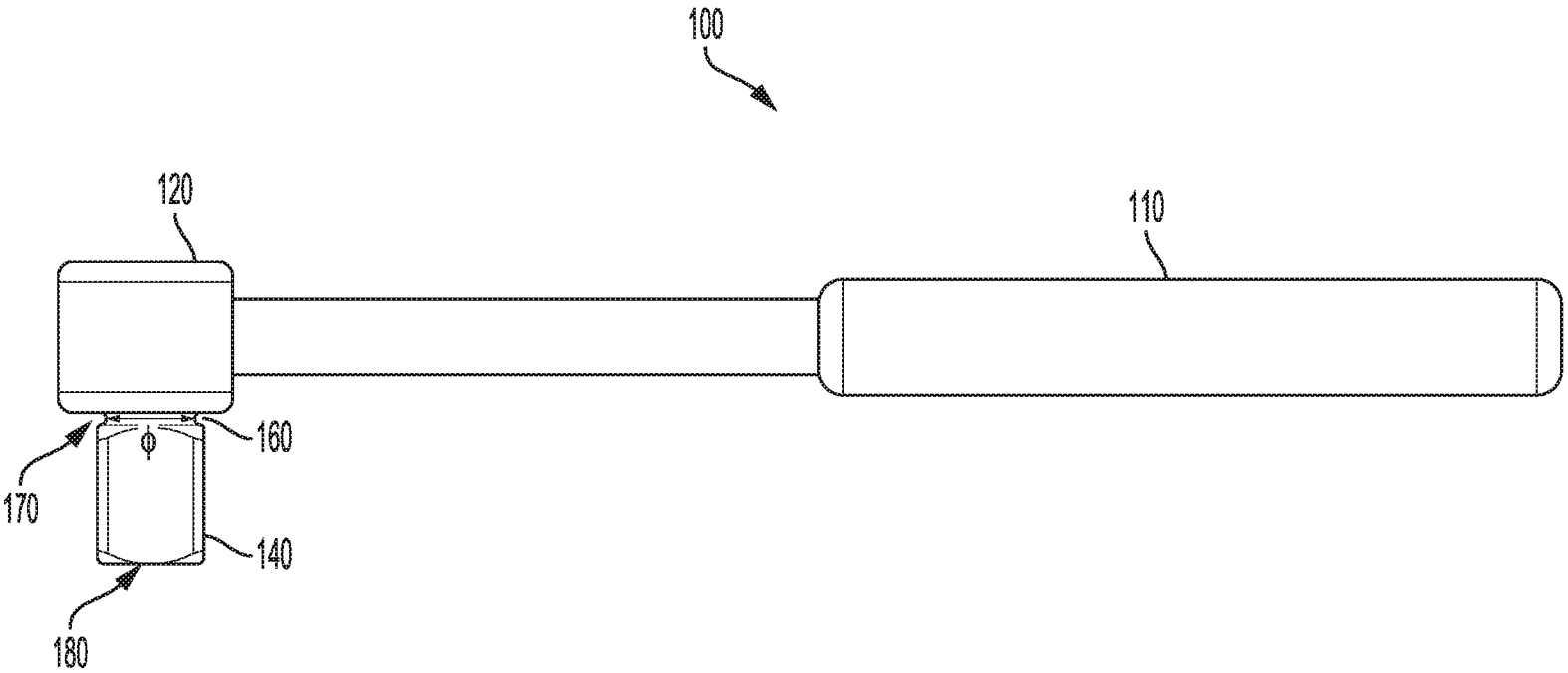
FIG. 1 is a side view of a tool incorporating an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly relates to a torque application tool, such as a ratchet tool, having a handle and a ratchet head extending from the handle, the ratchet head may include a cavity with a drive gear having circumferentially disposed gear teeth and one or more pawls adapted to selectively engage the gear teeth. The tool includes a drive lug adapted to accept and couple to sockets and other fastener engaging work pieces. The drive head includes a groove with a predetermined diameter formed on the drive lug. The diameter of the groove is predetermined to cause the drive lug to fail through torsional ductile fracture before an internal mechanism (including the gear and/or the pawl) fails or otherwise damages the tool.

As a result of these improvements, feedback can be provided to a user of the tool to alert the user that the tool is failing before a sudden fracture occurs, due to the ductile twist of the drive lug. This substantially reduces damage and/or failure of the internal (gear or pawl) structure of the tool.

Referring to FIGS. 1 and 2A-2D, a tool 100, such as a ratchet tool, is illustrated. The tool 100 may include a handle 110 and a ratchet head 120 coupled to and extending from the handle 110. The ratchet head 120 extends from the handle 110, and may include a cavity (not shown) to house internal ratcheting components including a gear having circumferentially disposed gear teeth and pawl(s) adapted to selectively engage the gear teeth.

For example, the ratchet head 120 includes a ratcheting mechanism including one or more pawls (not shown) and gear 130 with gear teeth. The interaction between the pawls and gear teeth allow a user to rotate the tool 100 in a first rotational direction, in which the pawl engages the gear teeth to apply a torque. The interaction between the pawls and gear teeth allow a user to rotate the tool 100 in a second rotational direction, opposite the first rotational direction, in which the pawl disengages the gear teeth and ratchets or slips about the gear 130 when the tool 100 is rotated in the second rotational direction.

The gear 130 may be formed integrally with a drive lug 140 that is adapted to engage and couple to a socket or other fastener engaging work piece. For example, the drive lug 140 may include a detent mechanism 150 for retaining a selected one of a plurality of interchangeable wrench sockets. The detent mechanism 150 may be an outwardly biased ball disposed on the drive lug 140. The ball may be outwardly biased by a bias member, such as a spring.

As illustrated, the drive lug 140 has a substantially square cross-sectional shape. However, the drive lug 140 may have any desired cross-sectional shape, such as triangular, pentagonal, hexagonal, or any other geometric shape as desired.

The drive lug 140 includes a groove 160 with a predetermined diameter D. The drive lug 140 includes a first end portion 170 proximate the ratchet head 120 of the tool 100 and a second end portion 180 distal from the ratchet head 120 of the tool 100. The groove 160 is formed on the drive lug 140 between the first end portion 170 and the second end portion 180, and proximal to the first end portion 170. The groove 160 is formed to promote failure of the drive lug 140 prior to failure of other components of the tool 100, such as the ratchet mechanism (the pawl(s) and/or gear 130).

Figure 2A:
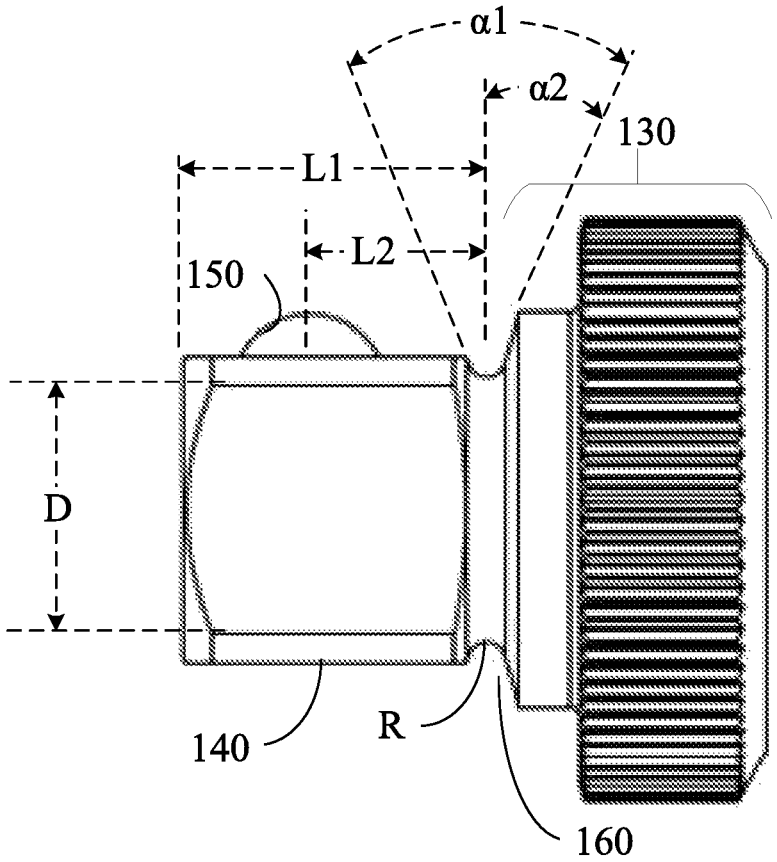
FIG. 2A is a first side view of a drive lug of a tool incorporating an embodiment of the present invention.
Figure 2B:
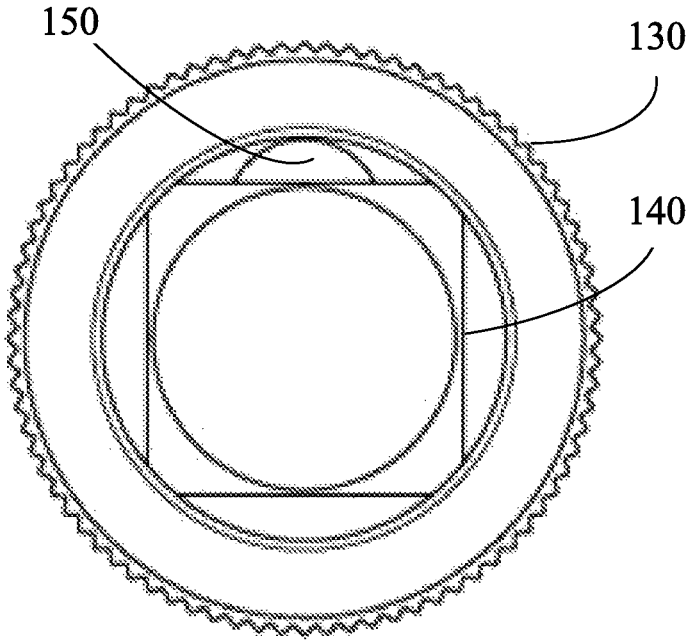
FIG. 2B is an end view of the drive lug of FIG. 2A.
Figure 2C:
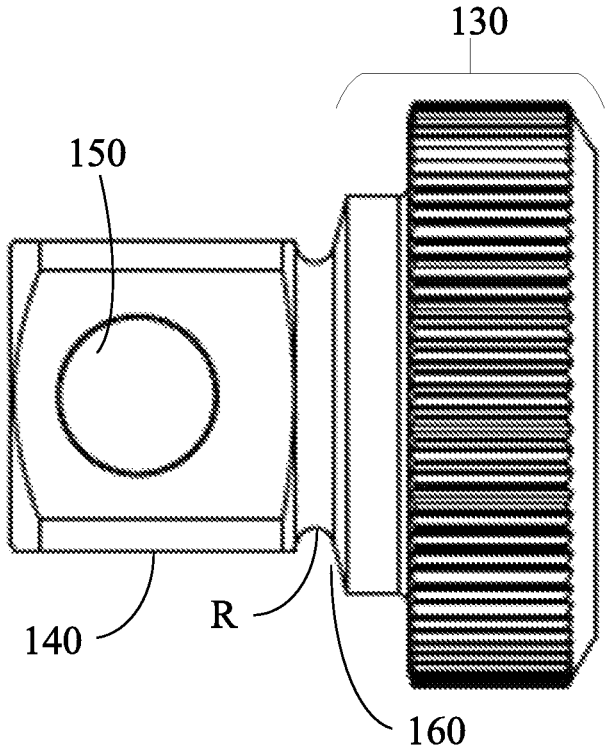
FIG. 2C is a second side view of the drive lug of FIG. 2A.
Figure 2D:
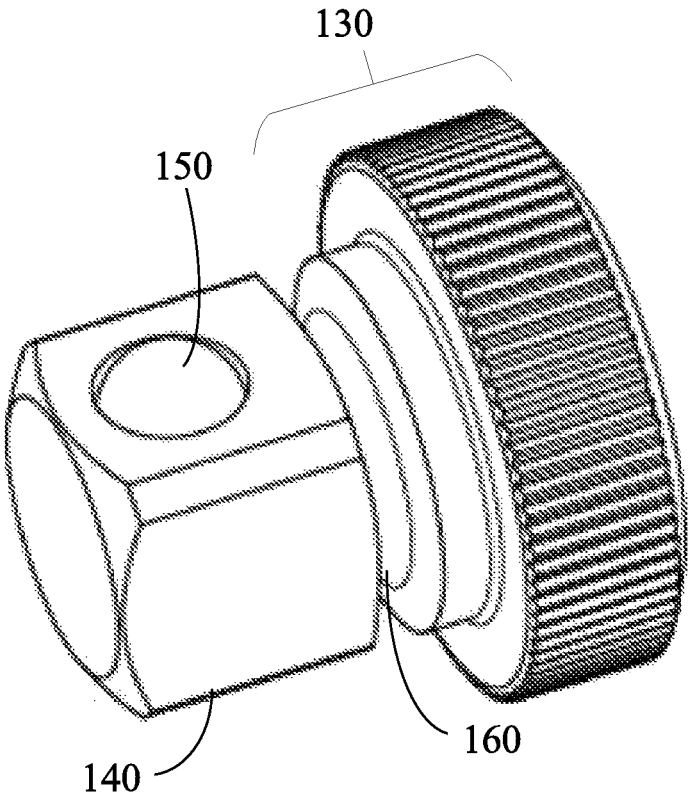
FIG. 2D is a perspective side view of the drive lug of FIG. 2A.

Referring to FIG. 2A, the predetermined diameter D includes a minimum diameter across the groove 160. The diameter D is determined to promote failure of drive lug 140 rather than failure of the ratchet mechanism, such as gear failure or pawl failure. To achieve this, the diameter D is determined based on torsional failure of a cylinder and/or polar moment directed to the design of the tool 100. A polar moment of inertia, also known as second polar moment of area, is a quantity used to describe resistance to torsional deformation (deflection) in cylindrical objects (or segments of cylindrical objects) with an invariant cross-section and no significant warping or out-of-plane deformation.

In one aspect, the diameter D is a diameter of a cylinder that torsionally fails at a same load as a drive lug for which the tool or a ratchet mechanism of the tool is designed. Another way to express the diameter D is that the diameter D is a diameter of a circle with a same second polar moment of area as a square section of a drive lug for which the ratchet mechanism is designed.

For example, for the drive lug 140 with sides of length x, the second polar moment $J_{square}$ is:

$$J_{square}=x^4/6$$

For a circle with a diameter of D, the second polar moment $J_{circle}$ is:

$$J_{circle}=\pi D^4/32$$

Thus, for equivalent polar moments:

$$J_{circle} = J_{square}$$

$$\pi D^4/32 = x^4/6$$

$$D^4 = 32x^4/6\pi$$

$$\sqrt[4]{D^4} = \sqrt[4]{\frac{32x^4}{6\pi}} = \sqrt[4]{\frac{32x}{6\pi}}\sqrt[4]{x^4}$$

$$D = 1.1415x$$

For example, the drive lug 140 may be a ⅜ inch square on a ¼ inch tool 100. In this example, the groove 160 may have a diameter D of about 0.285 inches. The drive lug 140 may have a length L1 (measured from a center of the groove 160 to the second end portion 180) of about 0.369 inches, and a length L2 (measured from a center of the groove 160 to a center of a detent 150) about 0.183 inches. In this example, the groove 160 has a radius of curvature R of about 0.031, and provides an angle of α1 of about 30 degrees, and an angle α2 of about 15 degrees.

Figure 3:
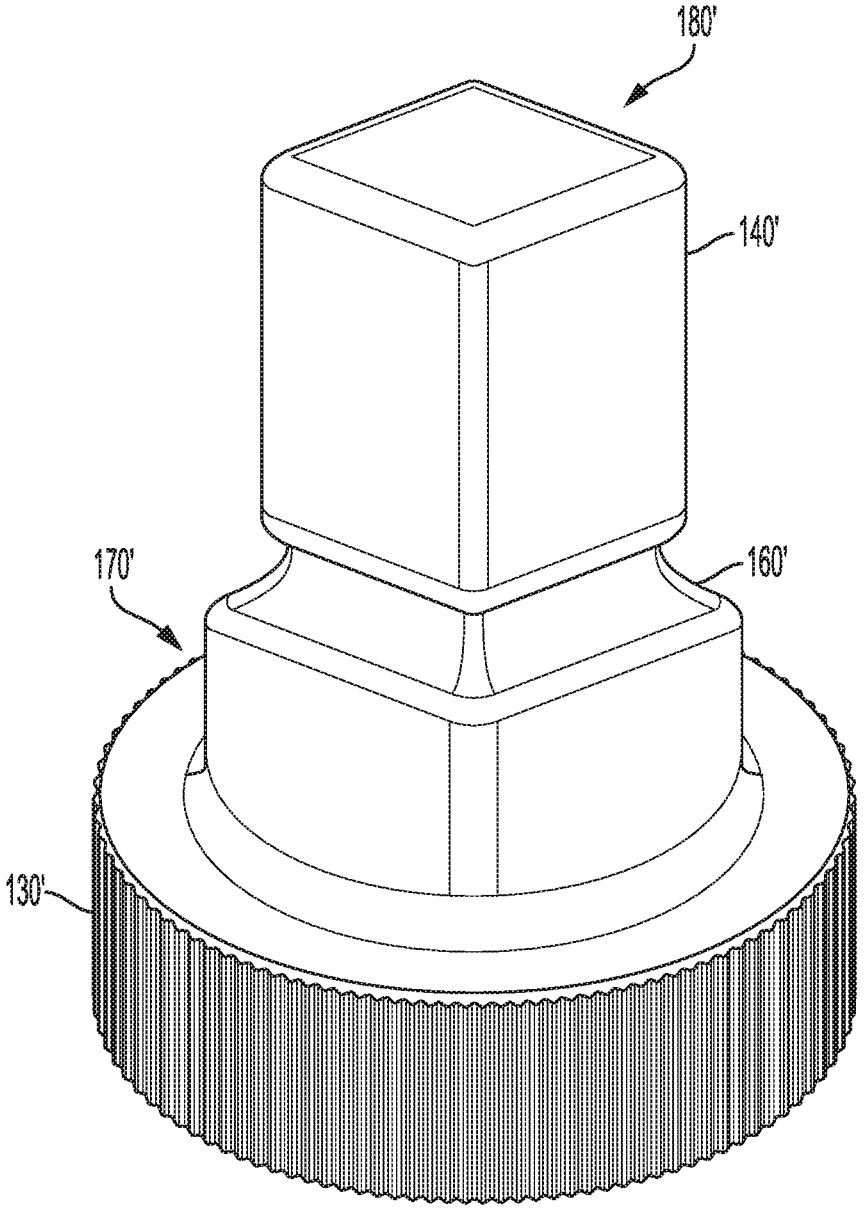
FIG. 3 is a side view of another drive lug incorporating an embodiment of the present invention.

While the groove 160 is shown and described as having a circular cross section, the groove may have other cross sectional shapes, with an equivalent diameter of the other shape being used to determine the appropriate failure point. For example, Referring to FIG. 3, the gear 130' may be formed integrally with a drive lug 140' that is adapted to engage and couple to a socket or other fastener engaging work piece. For example, the drive lug 140' may include a detent mechanism for retaining a selected one of a plurality of interchangeable wrench sockets. The detent mechanism may be an outwardly biased ball disposed on the drive lug 140'.

The drive lug 140' includes a groove 160' formed between a first end portion and a second end portion, and proximal to the first end portion. The groove 160' may have a substantially square cross-sectional shape, and still be formed to promote failure of the drive lug 140' prior to failure of a ratchet mechanism (the pawl(s) and/or gear) of the tool.

While the groove is described as being implemented in a drive lug of a ratchet wrench, it should be understood by those skilled in the art, that the present invention is not necessarily confined thereto but, rather, is applicable to a wide variety of ratchet mechanisms and other tool application tools. For example, the groove may be implemented in a drive lug or drive end of a screwdriver type tool, an electronic ratchet wrench, an impact wrench, a breaker bar and any other tool that has a driving end and internal components that are desired to be protected from sudden failure.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool including a gear and a pawl, the tool comprising:

a drive lug; and a groove formed in the drive lug and having a cross-sectional shape that has at least one of either a torsion constant and a second polar moment of area that are each adapted to cause failure of the drive lug prior to failure of either of the pawl or gear caused by torque applied by the tool to a work piece during operation of the tool.

2. The tool of claim 1, wherein the drive lug is a ⅜ inch square drive lug, and wherein the cross-sectional shape has a diameter that torsionally fails at a same load as a ¼ inch square drive lug.

3. The tool of claim 2, wherein the diameter is a minimum diameter across the groove.

4. The tool of claim 1, wherein the drive lug is a ⅜ inch square drive lug, and wherein the cross-sectional shape has a diameter of a circle with a same polar moment of area as a square section of a ¼ inch square drive lug.

5. The tool of claim 1, wherein the drive lug is a square drive lug.

6. The tool of claim 1, wherein the groove has an arcuate cross-section.

7. A tool comprising:

a handle;

a ratchet head extending from the handle and including a pawl and a gear; and a drive lug extending from the ratchet head and adapted to engage a work piece, the drive lug including:

a first end portion proximate to the ratchet head;

a second end portion distal from the ratchet head; and a groove formed in the drive lug between the first and second end portions, wherein the groove has a cross-sectional shape that has at least one of a torsion constant and a second polar moment of area that are each adapted to cause failure of the drive lug prior to failure of either of the gear or pawl caused by torque applied by the tool to a work piece during operation of the tool.

8. The tool of claim 7, wherein the drive lug is a ⅜ inch square drive lug, and wherein the cross-sectional shape has a diameter that torsionally fails at a same load as a ¼ inch square drive lug.

9. The tool of claim 8, wherein the diameter is a minimum diameter across the groove.

10. The tool of claim 7, wherein the drive lug is a ⅜ inch square drive lug, and wherein the cross-sectional shape has a diameter of a circle with a same second polar moment of area as a square section of a ¼ inch square drive lug.

11. The tool of claim 7, wherein the drive lug is a square drive lug.

12. The tool of claim 7, wherein the groove has an arcuate cross-section.

13. The tool of claim 1, wherein the drive lug has a length measured from a center of the groove to an end portion of the drive lug of about 0.37 inches.

14. The tool of claim 2, wherein the diameter is about 0.285 inches, and the groove has a radius of curvature of about 0.03.

15. The tool of claim 7, wherein the drive lug has a length measured from a center of the groove to the second end portion of the drive lug of about 0.37 inches.

16. The tool of claim 8, wherein the diameter is about 0.285 inches, and the groove has a radius of curvature of about 0.03.

17. The tool of claim 7, wherein the drive lug is integral with the gear.

18. The tool of claim 1, wherein the drive lug is integral with the gear.

* * * * *